US005435272A

United States Patent [19]

Epstein

[11] Patent Number: 5,435,272

[45] Date of Patent: Jul. 25, 1995

[54] SUPPORT HARNESS FOR A YOUNG CHILD

[76] Inventor: Benoit Dov Epstein, Manoir-de-Beauvoir, Tortisambert F-14140, Livarot, France

[21] Appl. No.: 193,097

[22] PCT Filed: Aug. 10, 1992

[86] PCT No.: PCT/FR92/00785

§ 371 Date: Mar. 31, 1994

§ 102(e) Date: Mar. 31, 1994

[87] PCT Pub. No.: WO93/02596

PCT Pub. Date: Feb. 18, 1993

[30] Foreign Application Priority Data

Aug. 8, 1991 [FR] France ..... 91 10137

[51] Int. Cl.[6] ..... A47D 13/04; A47D 13/08

[52] U.S. Cl. ..... 119/770; 119/857; 128/875; 182/6; 297/484

[58] Field of Search ..... 297/466, 484, 485; 119/770, 771, 769, 857; 128/875; 182/6

[56] References Cited

U.S. PATENT DOCUMENTS

| | | | |
|---|---|---|---|
| 1,310,958 | 7/1919 | O'Connor | 297/484 |
| 1,316,163 | 9/1919 | Kennedy | 128/875 |
| 2,212,796 | 8/1940 | Nunn | 119/770 |
| 2,568,304 | 9/1951 | Schoenbrun | 227/49 |
| 2,647,293 | 8/1953 | Wintercorn | 182/6 |
| 3,237,939 | 3/1966 | Olivet et al. | 272/70 |
| 3,408,408 | 3/1970 | Foote | 182/6 |
| 3,992,040 | 11/1976 | Gannac | 297/424 |
| 4,226,474 | 10/1980 | Rupert et al. | 297/484 |
| 4,308,629 | 1/1982 | Freemon | 119/770 |
| 4,329,204 | 4/1982 | Friedman | 119/771 |
| 4,378,921 | 4/1983 | Allen et al. | 182/6 |
| 4,645,033 | 2/1987 | Oelschlager | 182/6 |
| 4,759,569 | 7/1988 | Potter | 297/485 |
| 4,817,564 | 4/1989 | Giroux | 119/771 |
| 4,927,211 | 5/1990 | Bolcerek | 297/484 |
| 4,958,597 | 9/1990 | Milder | 119/771 |
| 4,981,110 | 1/1991 | Llewellyn | 119/96 |
| 5,074,795 | 12/1991 | Clark | 119/770 |

FOREIGN PATENT DOCUMENTS

| | | |
|---|---|---|
| 909523 | 10/1962 | United Kingdom . |
| 966637 | 12/1964 | United Kingdom . |
| 1076247 | 7/1967 | United Kingdom . |
| 1121546 | 7/1968 | United Kingdom . |

*Primary Examiner*—Paul J. Hirsch
*Attorney, Agent, or Firm*—Nilles & Nilles

[57] ABSTRACT

A harness comprises two loops (1, 2) to hold a toddler between the legs. A strap (3) is attached to the top of the loops for carrying the child. The movable straps (11, 12) fitted with handle (13, 14) are attached to the strap (3). When the child is guided by this harness, he can acquire the notions of balance more quickly through the use of the handles (13, 14).

13 Claims, 2 Drawing Sheets

SUPPORT HARNESS FOR A YOUNG CHILD

BACKGROUND OF THE INVENTION

This invention consists of a harness, garment, or an overall designed to be worn by babies or young children which guarantees vertical hold, and point(s) of application of lateral, externally oriented force(s), favoring the acquisition and general learning of the mechanics of walking and other complex movements.

The harness is designed to facilitate the learning process of walking for these children. For older, handicapped children undergoing physiotherapy, it is an aid to mobility. The invention can be used in a number of other situations notably during car journeys acting as a safety aid in case of accident; as an aid to the learning of swimming, crawling, climbing up and down stairs and for learning in safety of skating, skate boarding and skiing.

It is known that when teaching a child to walk at an early age, one usually holds him by the hands or arms. This method of learning presents two drawbacks. In the first instance the stance is tiring for the adult who is guiding the child. Secondly this method does little to develop the child's sense of balance. Furthermore, since the child does not yet have enough strength in his legs, he cannot regulate the weight applied to one leg at the time when he supports all his weight on one foot. The same phenomenon occurs when the child attempts to walk on his own even when holding on to furniture. He is preoccupied in mobilizing his physical strength to stand up and move forward, to avoid falling down and being afraid. Thus, he has little left during his experiments to carry out his own observations, checks and corrections and finally to memorise probative sequences.

Harnesses exist which are made from a structure of interlaced straps held together around the child's chest. Such a structure is attached to a rein which an adult can hold. This type of harness passes beneath the arms of the child thus leaving his hands free. One notices that the position of the center of thrust of these harnesses compared to the center of gravity of the child makes an instrument which is meant for holding children on a rein and not to hold children upright or standing on their feet at the parent's choice.

SUMMARY OF THE INVENTION

The purpose of this invention is to remedy this drawback by the following three principles. Firstly, a vertical position is assured. The baby is totally safe and realises this in a few seconds from his own observations, this having positive, immediate and obvious consequences. Secondly, the force required to hold the child upright is regulated by the parent's hand: this constitutes the first lever.

The assured vertical hold of the baby allows the adult, in addition to the aforementioned point, to control and measure out at will, the amount of weight he wishes each of the baby's legs to carry, which is equivalent to the possibility of having the lower part of the baby's body working in reduced gravity conditions,: conditions ideal for learning. Thirdly, the consequent improvement of the sustaining parallelogram of forces which includes the baby himself, constitutes a second lever. The harness puts lateral handles at the disposal of one or both of the baby's hands, in such a way that in taking hold of one of the handles, he can apply an outward pressure-variable at will. The baby's arm(s) is(are) oriented according to the resultant of the parallelogram of forces as follows: the upper line of force of the parallelogram runs from the baby's hand to the parent's hand through their respective straps and each of the two can adjust the amount of pull at will. The lower line of force of the parallelogram runs from the baby's hand to the opposite point of his body, this opposite point having its seat at the point of maximum pull on the harness which is close to the baby's center of gravity. This phenomenon creates extra stability to the system that consists of the body of the baby, as much in movement as when stationary, and this independently of the first principal which remains essential.

This harness allows a vertical force to be applied to the top of the child's legs. For example, this force is applied between the legs of the child. In these conditions, the physical effort required to maintain a vertical position is considerably reduced; the child no longer needs to devote his attention to expending physical effort but can concentrate on maintaining his balance. In addition, this harness provides the means to have a loose hold on the baby's balance thus avoiding the frequent falls which the baby would otherwise experience. Finally, to complete the invention, there are two handles which the child can hold on to. The child can, by exerting effort through his hands, learn to stand up or to regain his balance.

Consequently, with this harness, the child benefits both from help in remaining upright and by being able to help himself to balance by using his hands to pull on the handles. If in spite of all his efforts he falls, he is held by the upper part of the harness which is supported by the adult who is guiding the child.

This invention is therefore a harness designed to support a young child characterised by the fact that it provides the means to apply a vertical force to the top of the child's legs, a point of support near the shoulders or neck of the child and means, integral to the harness, which place handles within the reach of the child.

The invention will be better understood on reading the description which follows and examining the diagrams which accompany it. These are only given as a guide and not as a limitation to the invention. The diagrams show:

FIG. 1: a harness conforming to the invention.

FIG. 2: a preferred variation of this harness.

DESCRIPTION OF THE PREFERRED EMBODIMENTS

Figure 1:
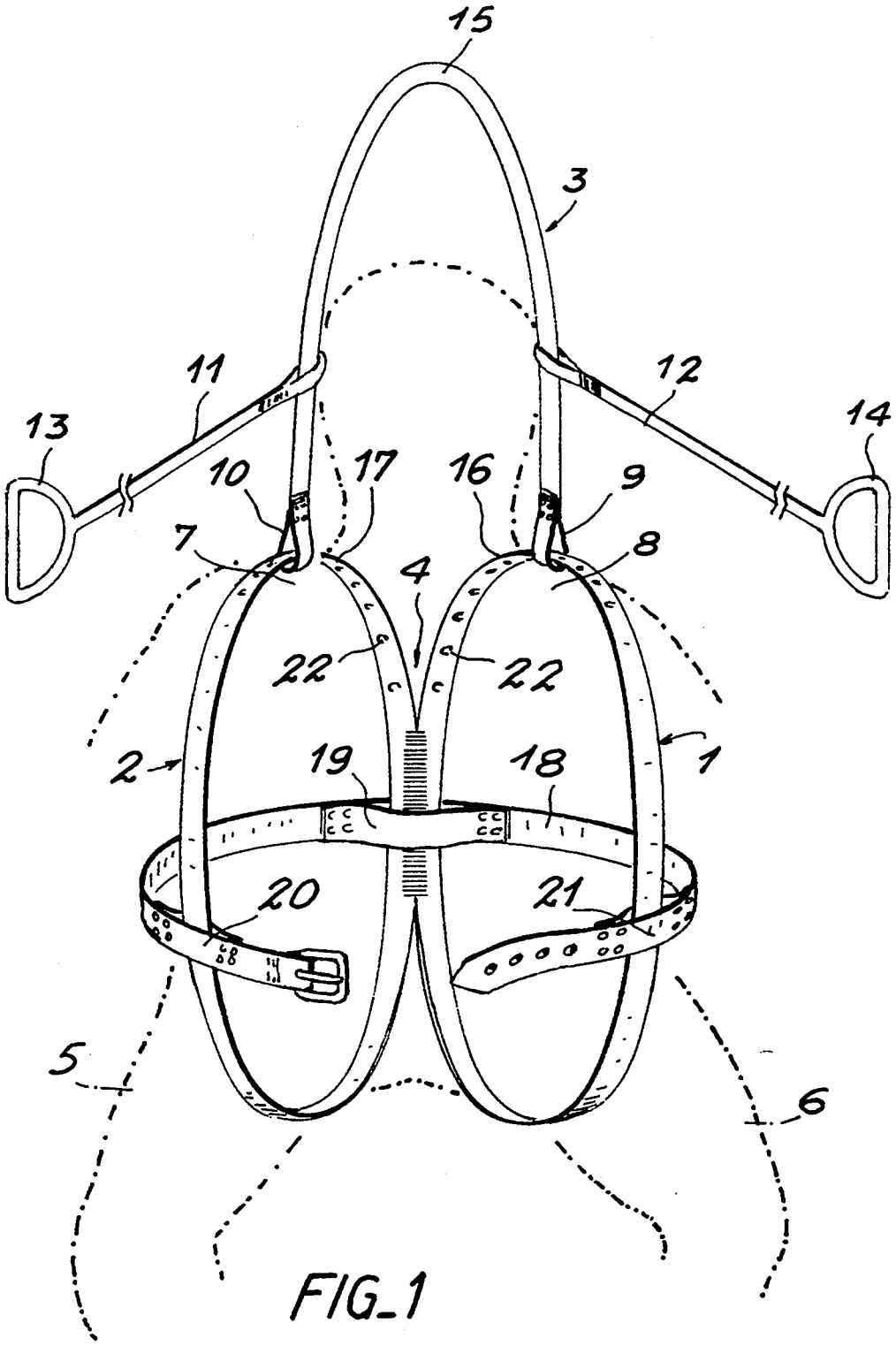

FIG. 1 shows a harness which conforms to the invention. This harness consists essentially of two main loops 1 & 2, hung from a handle loop 3.

In the preferred method of manufacture, the two main loops are joined together at the back of the harness 4. The joint between them can be made by, for example, sewing. The loops will each pass between the baby's thighs 5 & 6 and over his shoulders 7 & 8. The child is shown on the diagram as being transparent so it is easier to see the back of the harness. The two main loops as well as the handle loop are made from any flexible material, for example, without the following being a limitation to the invention, from leather, mackramé, plastic, nylon, tough material etc. . . .

The handle loop 3 is fixed to the main loops 1 & 2 preferably in a permanent way, and possibly in a way which allows them to be removed. The handle loop 3 can also have loops at its ends 9 & 10 made by folding the material of the handle loop back on itself and sewing having first passed them through the main loops 1 and 2, thus allowing them to be movable. Two straps 11 & 12 are also attached preferably to the handle loop 3 possibly in a way which allows them to be removed. These straps can also be attached to the handle 3 by means of folded loops as used for the handle loop itself. At their other ends, these straps are fitted with handgrips 13 & 14.

The dimensions of the harness are as follows: the height of the handle loop 3 from its highest point 15 to each of its points of attachment 9 & 10 is in the order of 40 centimeters. The size of each of the main loops 1 & 2 is similar: their length can be adjusted by buckles (not shown); the circumference of these loops is about 1 meter. The length of the straps 11 & 12 depends on where they are fixed to the harness. If the straps 11 & 12 are made as shown in the diagram, with fixing points at the base of the handle loop 3, they measure about 30 centimeters each. The dimension also applies if they are fixed to the tops 16 & 17 of the main loops 1 & 2. On the other hand, if the straps 11 & 12 are fixed to points near the top 15 of the handle loop 3 they will be longer and will measure about 70 centimeters each. The fixing of the straps 11 & 12 to the top 15 of the handle loop or to other high positions in between, will result in different balancing characteristics to those obtained if they are fixed to the main loops at points 16 & 17 or even when they slide to the bottom of the handle loop 3. Any one of these solutions could be chosen depending on the difficulties encountered by the user. By preference we would favor the fixing of the straps 11 & 12 to the low part of the handle loop 3 or the high points 16 & 17 of the main loops 1 & 2.

In the search for perfection, and not because it is strictly necessary, the harness can be equipped with a belt 18 which slides by means of the loops 19, 20 and 21 along the main loops 1 and 2. One could thus move the belt to place it at the same height as a belt worn by the child. The loops 19, 20 and 21 are made by sewing strips of material to the belt itself.

In the same way that several different materials can be used, the methods of fixing the handle loop and the main loops can be varied. For example, one can replace the sewing on the folded-back loops with rivets, or even welding or glueing if the different loops and straps of the harness are made from plastic. These fixings can also be removable and so can be press studs, buckles or "Velcro" type fixings. Also, rather than being made as a separate item, the loops 1 & 2 as well as the belt 18 and the handle loop 3 can be incorporated into a garment such as, for example, dungarees or a one piece suit which would include reinforcing at the points where the weight is taken at the shoulders 7 & 8. In this case, the handle loop 3 is fixed when needed to points near the shoulders on the garment.

The harness functions as follows: when one holds the handle loop 3 at its highest point 15 and applies a vertical force, this is transferred to an area between the legs of the child who is thus supported. As the child learns, the amount of effort applied by the adult can be reduced. Held up between his legs, the child can concentrate on his balance and if he needs, can reestablish this by pushing or pulling on the handles 13 & 14. If his efforts are in vain, he looses his balance. At this moment his torso presses against the front of the main loops 1 & 2 which surround him. He is thus held up and cannot hurt himself.

At the back of the harness, from about the point where the two main loops are joined 4 and towards the tops 16 & 17 of the main loops 1 & 2, one can include a series of fixing points such as eyelets of the type shown 22, made in each of the main loops 1 & 2 to allow the fixing of another device (preferably a belt) which would attach the harness to a special car seat. In this case the harness would act as a safety belt worn on the body.

Finally, by selecting a strap which is sufficiently wide, one can use the harness to carry the child when out walking or when he is tired. In this case, the handle loop 3 is used as a shoulder strap by the adult who is carrying the child.

Figure 2:
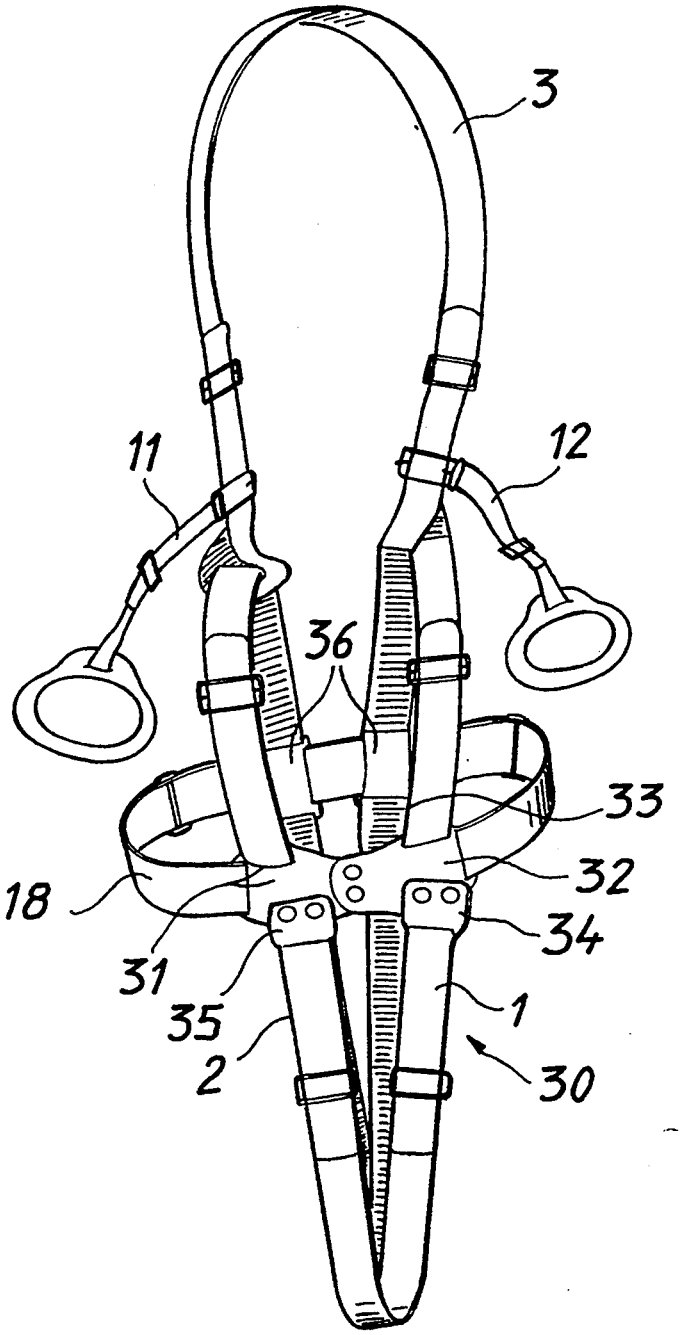

FIG. 2 shows a variation of the harness within the scope of the invention.

This preferred variant also has two main loops 1 & 2 designed to pass between the legs of the baby. Since however, it has been found that when the loops are separate (as in the case of FIG. 1) where they pass between the baby's legs, they can cause sores because of pinching. To avoid this problem, we had the idea of crossing the loops. This means that the rear part of loop 1 becomes, after passing between the legs, the front part of loop 2 passing over the torso. In the same manner, the rear part of loop 2 becomes the front part of loop 1. This arrangement is made easier by the use of a central clasp assembly 30 forming a buckle for the belt 18. This clasp assembly consists of four PVC plates. The first two plates 31 & 32 are attached to the ends of the belt and hook into each other by means of gaiter buttons 33. This buttoning system is made possible by means of elongated narrowing holes in plate 32. Plate 32 locks into plate 31 by means of mushroom shaped knobs projecting from plate 31. The clasp assembly has two other sections 34 & 35, these also being made from PVC and fixed to the ends of the main loops 1 & 2. In this case too, the plates 34 & 35 are fixed to plates 31 & 32 by gaiter button type fixings. This allows easy fitting of the harness around the child's body.

In this variant, the seam 4 which links the two main loops has been abandoned and is replaced by junctions such as 36 which can slide along the belt 18. The handle loop 3, the belt 18 as well as the main loops 1 & 2 are equipped with buckles to allow adjustments to the size of the child.

In this preferred variant, the straps 11 & 12 are retained since, because of their suppleness and their ability to articulate freely from their point of attachment to the handle loop 3, allow the child to maintain his balance whilst at the same time preventing him from swinging from the handles. If this were to be allowed, it would have the effect firstly of tiring the adult who was guiding the child and secondly of limiting the child's progress in learning to walk.

The simple design of the harness allows its easy manufacture without need for specialized equipment. In effect it is only necessary to assemble the various straps. The other pieces, i.e. buckles, loops, clasp assembly sections and handles can all be mass produced by injection moulding. The manufacturing cost of this harness is thus kept very low.

I claim:

1. A harness for holding a young child, said harness comprising:

(A) means, including two vertical main loops, for passing between the legs of the child and for applying a vertical lifting force to the child;

(B) means, including a handle loop which is attached to an upper portion of each of said main loops, for permitting a holding force to be placed on said harness near the shoulders of the child by another person; and (C) means, including a pair of handles, for permitting the child to apply outward pressure on said harness, each of said handles extending generally laterally from said harness and being attached to an element comprising one of (1) a respective one of said main loops and (2) said handle loop, each of said handles comprising a handgrip and a supple strap having a first end fixed to said handgrip and a second end fixed to said element.

2. A harness as defined in claim 1, wherein said handle loop is formed from a strap.

3. A harness as defined in claim 1, further comprising a body belt attached to said main loops and extending around the waist of the child.

4. A harness as defined in claim 3, wherein said main loops are joined together at a point on the child's back.

5. A harness as defined in claim 1, wherein said belt is formed from a unitary strap and a buckle.

6. A harness as defined in claim 3, wherein said main loops cross each other between the child's legs.

7. A harness as defined in claim 6, wherein said belt is formed from multiple sections joined to one another and to said main loops via a central clasp assembly.

8. A harness as defined in claim 1, further comprising means, provided on said main loops, for permitting attachment of said harness to a car seat restraint.

9. A harness as defined in claim 8, wherein said means for permitting attachment comprises eyelets formed in said main loops.

10. A harness for holding a young child, said harness comprising:

(A) two vertical main loops adapted to pass between the legs of the child;

(B) a handle loop which is attached to an upper portion of each of said main loops and which permits a holding force to be placed on said harness near the shoulders of the child by another person; and (C) a pair of handles extending generally laterally from said harness and being attached to an element comprising one of (1) a respective one of said main loops and (2) said handle loop, each of said handles comprising a handgrip and a supple strap having a first end fixed to said handgrip and a second end fixed to said element.

11. A method of holding a young child, said method comprising:

(A) applying a vertical lifting force to the child using two vertical main loops, passing between the legs of the child;

(B) placing a holding force on said harness near the shoulders of the child by another person using a handle loop which is attached to an upper portion of each of said main loops; and (C) applying an outward pressure on said harness by said child using on a pair of handles each of which is attached to and extends generally laterally from an element comprising one of (1) a respective one of said main loops and (2) said handle loop, each of said handles comprising a handgrip and a supple strap having a first end fixed to said handgrip and a second end fixed to said element.

12. A method as defined in claim 11, wherein said steps (B) and(C) create a parallelogram of forces which support and balance the child.

13. A method as defined in claim 12, wherein said parallelogram of forces includes (1) an upper line of forces running from one of the child's hands to one of the other person's hands through one of said handles and said handle loop and (2) a lower line of force running from one of the child's hands to a point on the child's body located near the child's center of gravity.

* * * * *